US006655611B2

(12) United States Patent
Muller-Girard, Jr. et al.

(10) Patent No.: US 6,655,611 B2
(45) Date of Patent: Dec. 2, 2003

(54) ELECTROMAGNETIC FUEL INJECTOR COMPRISING FLEXIBLE ELEMENT FOR POSITIONING ARMATURE

(75) Inventors: Otto Muller-Girard, Jr., Rochester, NY (US); Michael Schneider, Rochester, NY (US); Harrie William Bonnah, II, East Grand Rapids, MI (US); Karl Jacob Haltiner, Jr., Fairport, NY (US); Robert B. Perry, Leicester, NY (US)

(73) Assignee: Delphi Technologies, Inc., Troy, MI (US)

( * ) Notice: Subject to any disclaimer, the term of this patent is extended or adjusted under 35 U.S.C. 154(b) by 151 days.

(21) Appl. No.: 09/781,764

(22) Filed: Feb. 12, 2001

(65) Prior Publication Data

US 2003/0111559 A1 Jun. 19, 2003

(51) Int. Cl.[7] ..... B05B 1/30
(52) U.S. Cl. ..... 239/585.3; 239/900
(58) Field of Search ..... 239/585.3, 900

(56) References Cited

U.S. PATENT DOCUMENTS 4,356,980 A * 11/1982 Krauss ..... 239/585.3
4,390,130 A * 6/1983 Linssen et al. ..... 239/585.3
6,161,783 A * 12/2000 Press ..... 239/585.3
6,336,621 B1 * 1/2002 Ii et al. ..... 251/129.15

* cited by examiner

*Primary Examiner*—Christopher Kim
(74) *Attorney, Agent, or Firm*—Patrick M. Griffin

(57) ABSTRACT

An electromagnetic fuel injector comprises a body having a fuel inlet and a fuel outlet and a base comprising a valve seat sealably connected to the body. A disk-shaped armature disposed at the fuel outlet for controlling the flow of fuel has an upper surface and a lower surface that comprises a sealing interface with the valve seat. A ring-shaped flexural element comprising a plurality of spaced flexural legs is in contact with the injector body and the upper surface of the armature and provides a spring bias between the body and armature upper surface. When the injector is closed, spring bias between the body and armature upper surface maintains the armature in a sealing position with the valve seat, and when the injector is open, increased spring bias between the body and armature upper surface impels the armature to return to a sealing position with the valve seat.

4 Claims, 6 Drawing Sheets

ELECTROMAGNETIC FUEL INJECTOR COMPRISING FLEXIBLE ELEMENT FOR POSITIONING ARMATURE

TECHNICAL FIELD

The present invention relates to fuel injectors for delivery of fuel to the intake system of an internal combustion engine and, more particularly, to an electromagnetic fuel injector having a disk-shaped armature.

BACKGROUND OF THE INVENTION

Inclusion of a disk-shaped instead of a cylindrical armature in an electromagnetic fuel injector provides important advantages, including compactness, a substantial reduction in the mass of the armature, greatly diminished sliding friction during operation of the injector, and a consequent reduction in wear. Use of a disk-shaped armature, however, also presents some problems. During operation of the injector, the armature must be relatively precisely positioned as it contacts the valve seat in order to sufficiently prevent or control the flow of fuel to the combustion chamber. In operation, the armature is urged toward the valve seat by a return spring. The spring acts on a relatively small surface area of the armature. The return spring force is often not uniform on the surface. Uneven spring forces may tilt or tip the armature or otherwise fail to properly seat the armature on its valve seat. A conventional disk-shaped armature has a tendency to tip as it returns to its closed position, resulting in improper valve seating and undesirable fuel leakage. In the past, disk-shaped armatures have been treated with a lubricious coating to reduce friction and binding so as to encourage proper seating alignment. Coating of the armature, which requires additional processing steps, adds to the manufacturing costs of the armature. Also, in the prior art, in order to encourage proper seating alignment, disk-shaped armatures have been hinged to the mating seat. The hinged design requires precise assembly techniques which again adds to the manufacturing costs. Thus, there is a continuing need for a fuel injector comprising a disk-shaped armature that is reliably returned to a proper alignment with a valve seat during operation of the injector. Also, what is needed in the art is a reliable and inexpensive way of accomplishing this. These needs are addressed by the present invention.

SUMMARY OF THE INVENTION

The present invention is directed to an electromagnetic fuel injector having a disk-shaped armature that is biased in the closing direction by a ring-shaped flexible element and maintains a degree of lateral and rotational freedom to reliably seat itself when biased closed. The fuel injector of the present invention comprises a body having a fuel inlet and a fuel outlet and a base having a valve seat. A disk-shaped armature is disposed at the fuel outlet for controlling the flow of fuel. The armature has an upper surface and a lower surface that comprises a sealing interface with the valve seat. A flexible element comprising a ring, and at least one flexible leg projecting from the ring is in contact with the injector body and the upper surface of the armature and provides a spring bias between the body and armature upper surface. When the injector is closed, a spring bias from the return spring and the flexure act on the armature upper surface to maintain the armature in a sealing position with the valve seat, while permitting a degree of lateral and rotational freedom for the armature to be positioned flatly on the seat. When the injector is open, the return spring is compressed and the flexure is bent. With the injector open, there is an increase in spring bias between the body and armature upper surface to impel the armature to return to a sealing position with the valve seat when the solenoid is de-energized.

By disposing the flexures on the outer annular surface of the armature, the combined bias forces of the spring and the flexures are more stable and reliable in seating the armature than a spring only embodiment. The flexure forces provide a seating force on the outside of the armature to balance the central seating force of the return spring. With the invention, spring seating forces act on both the central surface portion of the armature and outer peripheral annular portions of the armature. Thus, the seating force is distributed across the surface of the armature and is not concentrated directly above the valve seat. By distributing the seating forces across the upper face of the armature, the invention more reliably seats the armature on the valve seat.

The flexures also provide radial inward forces that urge the armature to a centered position over the valve seat. As such, the flexures provide some radial restraint to resist lateral displacement of the armature during its travel from its open to its closed position on the valve seat. The invention does not require the hinges used by conventional injectors. Instead, the invention relies on the radial bias forces of the flexures to generally center the armature without connecting the armature to the valve seat.

An advantage of the present invention is that an inexpensive, reliable disk-shaped armature can be used in an electromagnetic fuel injector without the need for coating the armature or hinging the armature to assure proper seating.

Another advantage of the present invention is that some traditional, costly, precision assembly techniques need not be used to manufacture the fuel injector.

A further advantage of the present invention is that the disk-shaped armature is positively urged to return to a proper alignment with its valve seat during operation of the injector.

DESCRIPTION OF THE PREFERRED EMBODIMENT

Figure 1:
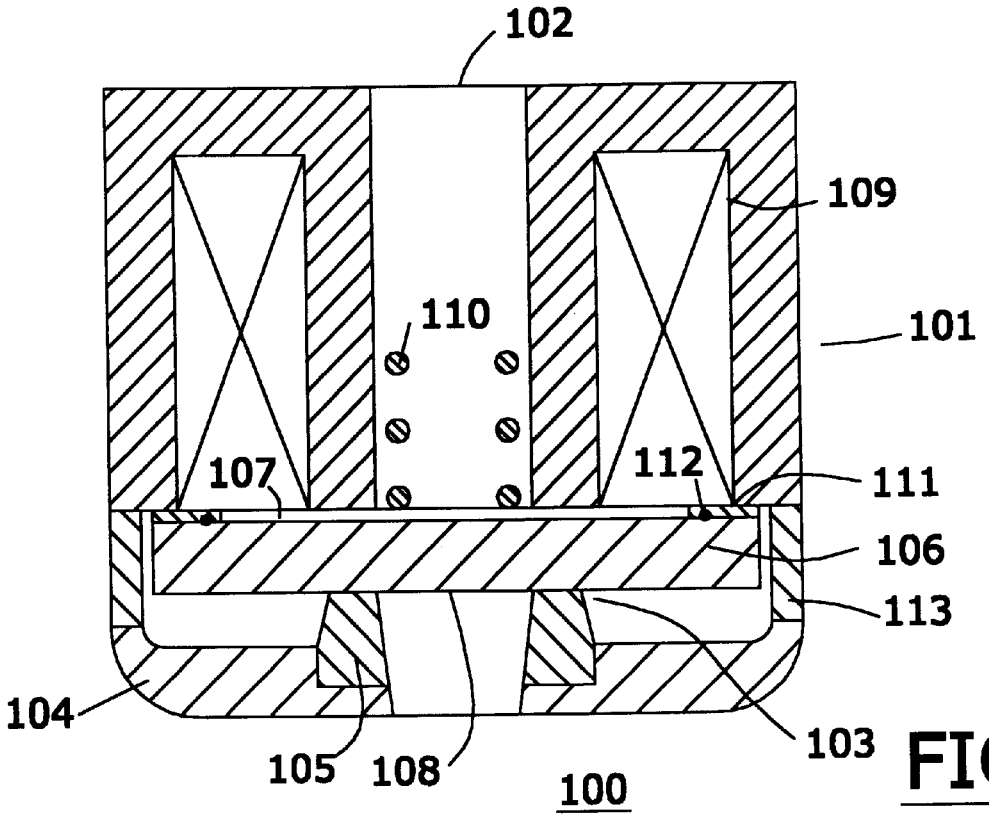
FIGS. 1 and 2 are side cross-sectional views of two embodiments of the fuel injector of the present invention shown in its closed position that include a ring-shaped flexible element situated between the valve body and the armature.

FIG. 1 schematically depicts a fuel injector 100 comprising a body 101 having a fuel inlet 102 and a fuel outlet 103 and sealably connected to a base 104 that includes a valve seat 105. Fuel injector 100 generally operates as described in U.S. Pat. No. 5,348,233, the disclosure of which is incorporated herein by reference. A disk-shaped armature 106, which is constructed of a magnetic material, preferably stainless steel, includes an upper surface 107 and a lower surface 108 that provides a sealing interface with valve seat 105.

Body 101 includes a solenoid actuator 109 and a closing spring 110. A ring-shaped flexible element 111, constructed of a non-magnetic material such as, for example, austenitic stainless steel, is positioned between body 101 and armature 106 and is attached to armature upper surface 107 by, for example, spot welds 112. Flexible element 111 has an outer diameter slightly smaller then the inner diameter of a spacer ring 113 disposed between body 101 and base 104. Solenoid actuator 109, when energized, causes armature 106 to be urged upward and away from valve seat 105 thereby compressing return spring 110 and flexing flexible element 111. On deactivation, return spring 110 and flexible element 111 causes armature 106 to move downward and armature lower surface 108 to seal against valve seat 105, thereby shutting off the flow of fuel. The operation of flexible element 111 facilitates the sealing of armature 106 with valve seat 105 and permits a degree of lateral and rotational movement of armature 106.

The return spring acts on the central portion of the armature. The flexure acts on the peripheral portion. The flexure force acts on the outer annular portion of the flexible element to urge the armature against the valve seat. The flexible element 111 also acts radially to urge the armature into a central position above the valve seat. Nevertheless, the flexible element 111 provides sufficient lateral flexibility to accommodate some lateral displacement of the armature and still seat the armature on the valve seat.

Figure 2:
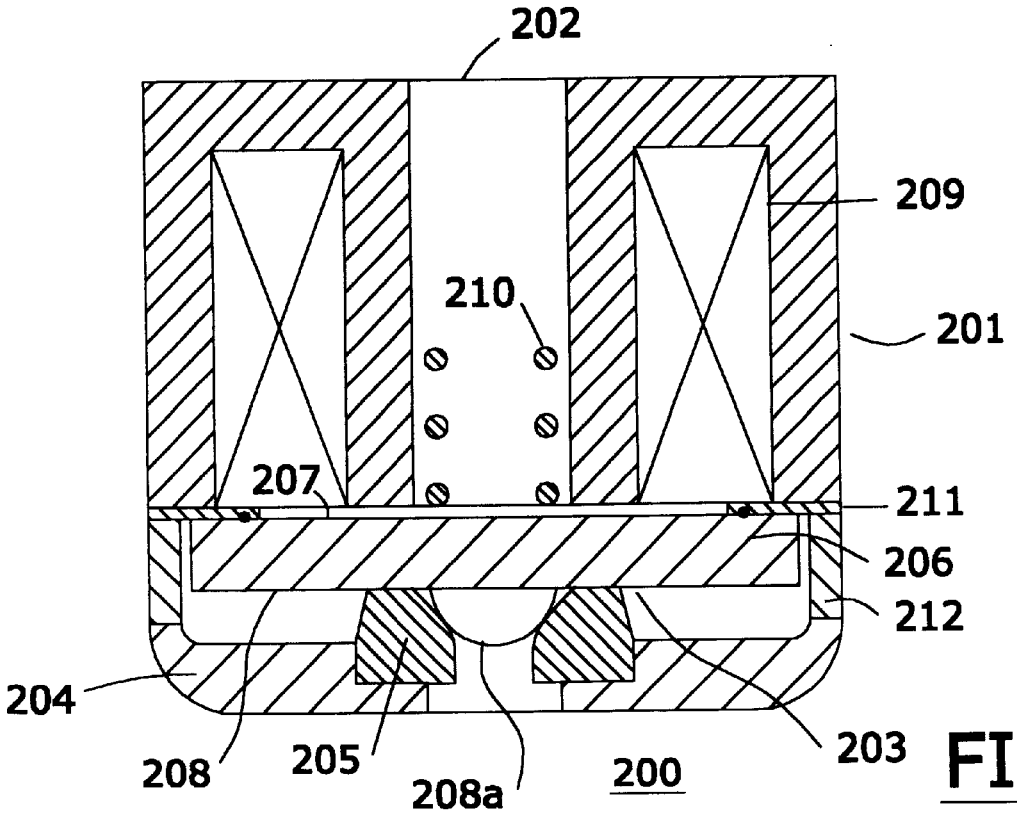

FIG. 2 depicts a further embodiment of the present invention, fuel injector 200, comprising a body 201 having a fuel inlet 202 and a fuel outlet 203 and sealably connected to a base 204 that includes a valve seat 205. A disk-shaped armature 206, which is constructed of a magnetic material, preferably stainless steel, includes an upper surface 207 and a lower surface 208 that optionally includes a ball element 208*a* that seals against valve seat 205. Body 201 includes a solenoid actuator 209 and a closing spring 210. A ring-shaped flexible element 211, constructed of a non-magnetic material, is clamped between body 201 and a spacer ring 212 that is disposed between body 201 and base 204. Solenoid actuator 209, when energized, causes armature 206 to be urged upward and away from valve seat 205 thereby compressing return spring 210 and flexing flexible element 211. On deactivation, return spring 210 and flexible element 211 causes armature 206 to move downward and armature lower surface 208 to sealably contact valve seat 205, thereby shutting off the flow of fuel. The operation of flexible element 211, which facilitates the sealing of armature 206 with valve seat 205, and permits a degree of lateral and rotational movement of armature 206.

Figure 3A:
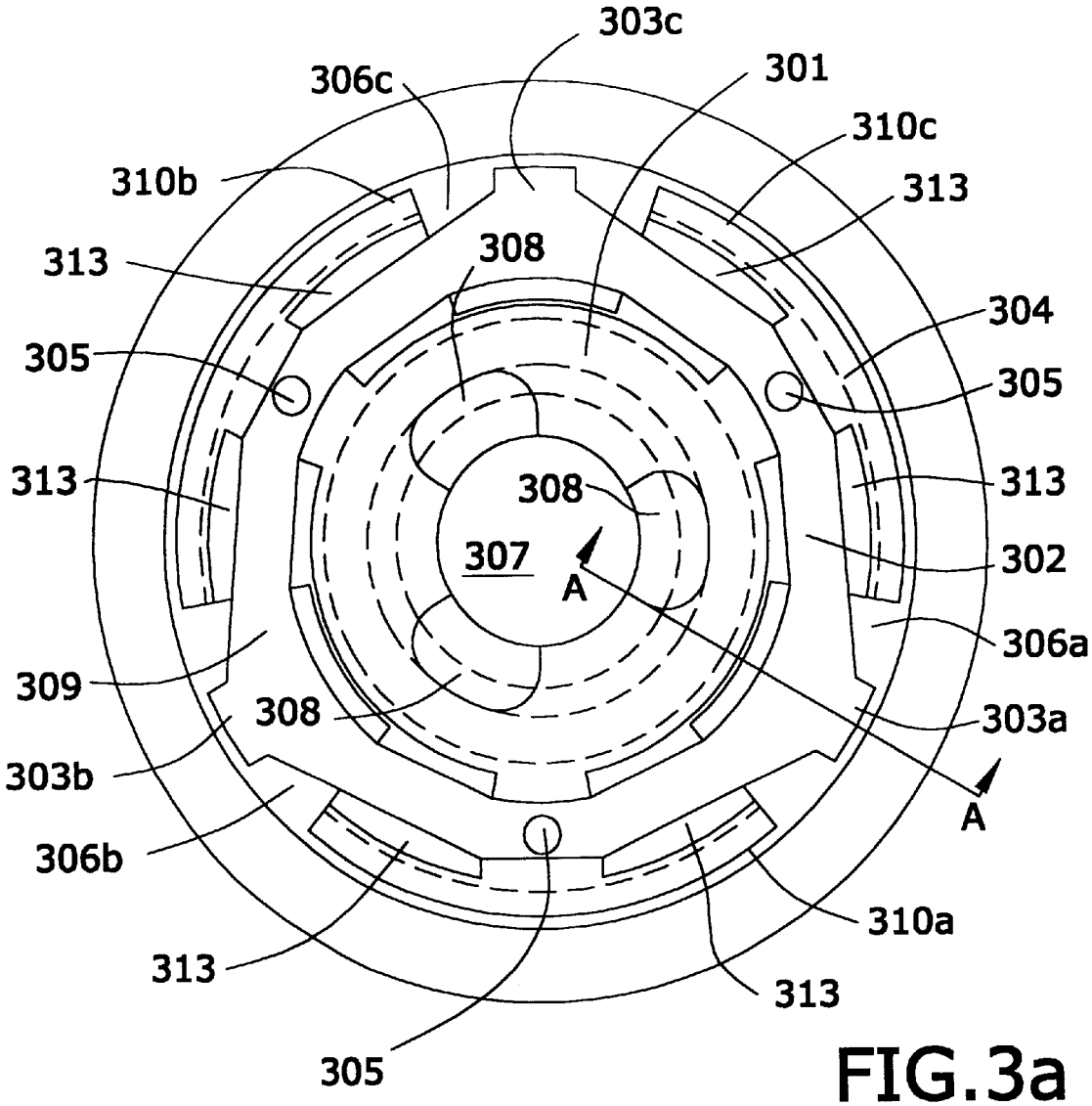
FIG. 3*a* is an upper plan view depicting a disk-shaped armature and one embodiment of a flexible element in accordance with the present invention.
Figure 3B:
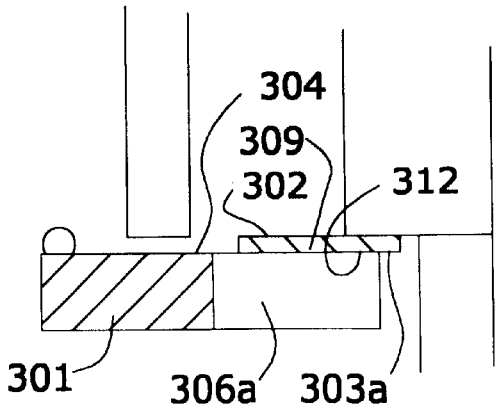
FIG. 3*b* is a cross-sectional view of the embodiment shown in FIG. 3*a*, taken along line A—A.

FIGS. 3*a* and 3*b* show a disk-shaped fuel injector armature 301 and a ring-shaped flexible element 302 (corresponding to flexible element 111 in FIG. 1) that includes a ring portion 309, and three spaced, outwardly projecting flexible legs 303*a*, 303*b*, and 303*c*. Flexible legs are disposed between upper surface 304 of armature 301 and injector body surface 312 and in contact with injector body surface 312. Ring portion 309 of flexible element 302 is attached to armature upper surface 304 by, for example, spot welds 305. Armature 301 optionally comprises three spaced apart sectors 310*a*, 310*b*, and 310*c*, which are separated by clearance pockets 306*a*, 306*b*, and 306*c*. Each sector comprises recesses 313 which provide clearance for flexible element 302 to reside when the solenoid is activated and armature 301 is urged upward and away from valve seat. Armature 301 further optionally includes a centrally disposed ball element 307 surrounded by apertures 308.

Flexible element 302 is in contact with the injector body surface 312 and with upper surface 304 of armature 301 and provides a spring bias between the body and upper surface 304. Each of the outwardly projecting legs 303*a, b, c* is located in one of clearance pockets 306*a, b, c*. When the fuel injector is in a closed position, spring bias between the body and armature upper surface 304 maintains armature 301 in a sealing position with the valve seat. As armature 301 lifts under the influence of magnetic force to its open position, flexible element 302 is deflected, thereby increasing spring bias between the body surface 312 and armature upper surface 304 and urging armature 301 to return to a sealing position with the valve seat. Since there is a slight clearance between the outer diameter of flexible element 302 and the inner diameter of the spacer ring (spacer ring 113 in FIG. 1), armature 301 has sufficient lateral and rotational freedom both to allow its proper seating with the valve seat and minimize sliding friction during opening and closing of the injector.

Figure 4A:
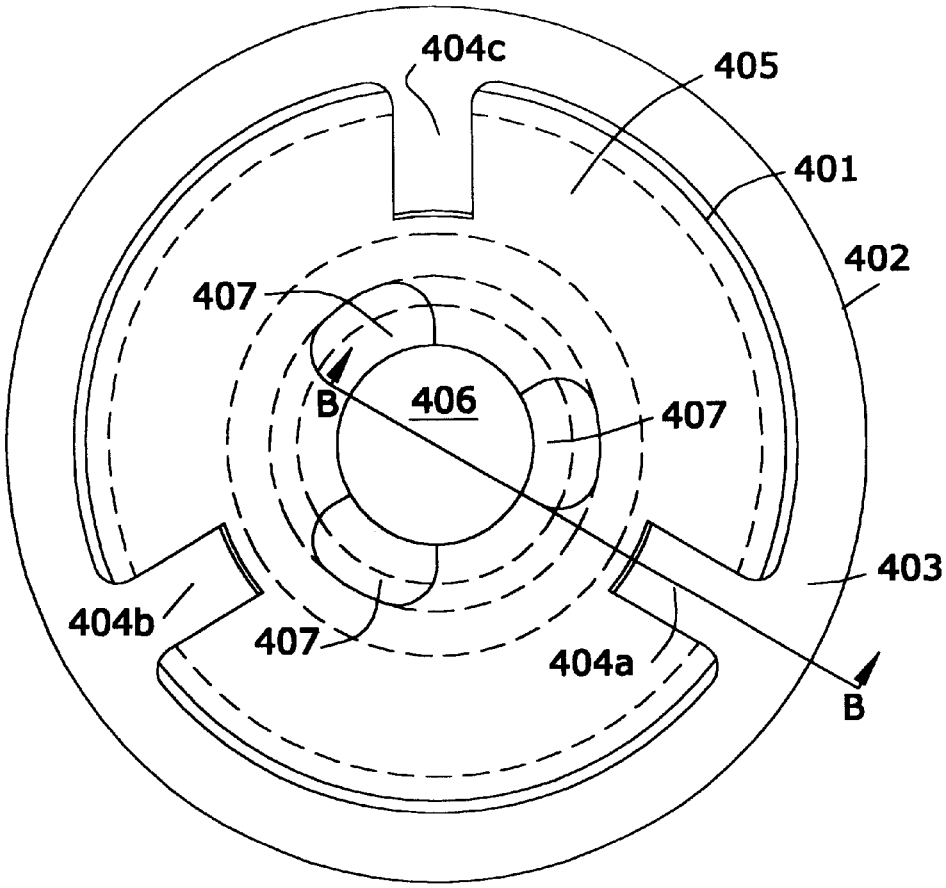
FIG. 4*a* is an upper plan view depicting a disk-shaped armature and a further embodiment of a flexible element in accordance with the present invention.
Figure 4B:
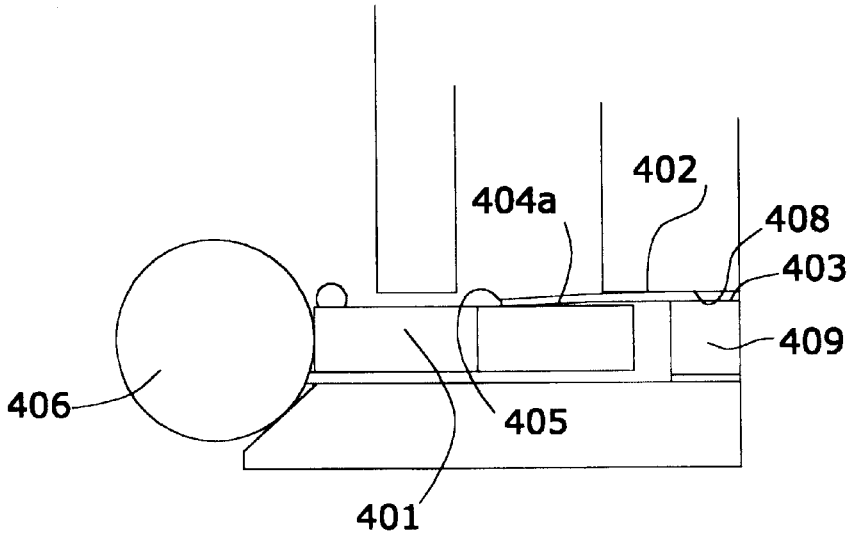
FIG. 4*b* is a cross-sectional view of the embodiment shown in FIG. 4*a*, taken along line B—B.

FIGS. 4*a* and 4*b* depict a disk-shaped fuel injector armature 401 and a ring-shaped flexible element 402 (corresponding to flexible element 211 in FIG. 2) that includes a ring portion 403 and three spaced, inwardly projecting flexible legs 404*a*, 404*b*, and 404*c*, which are in contact with an upper surface 405 of armature 401. Ring portion 403 of flexible element 402 is clamped between the injector body surface 408 and spacer ring 409. Armature 401 optionally includes a centrally disposed ball element 406 surrounded by apertures 407.

Flexible element 402 operates in a manner substantially similar to that describe for flexible element 302. When the fuel injector is closed, spring bias between the body surface 408 and armature upper surface 405 maintains armature 401 in a sealing position with the valve seat, and when the injector is open, increased spring bias between the body surface 408 and armature upper surface 405 impels armature 401 to return to a sealing position with the valve seat.

When the fuel injector is in its closed position, the preload exerted by flexible legs 404*a, b, c* stabilizes armature 401 to control its attitude. With the injector in the open position, the deflection of legs 404*a, b, c* provides additional spring force to facilitate proper seating of armature 401. Since flexible element 402 is not attached to armature 401, it has sufficient freedom of lateral and rotational movement to ensure its proper positioning.

Figure 4C:
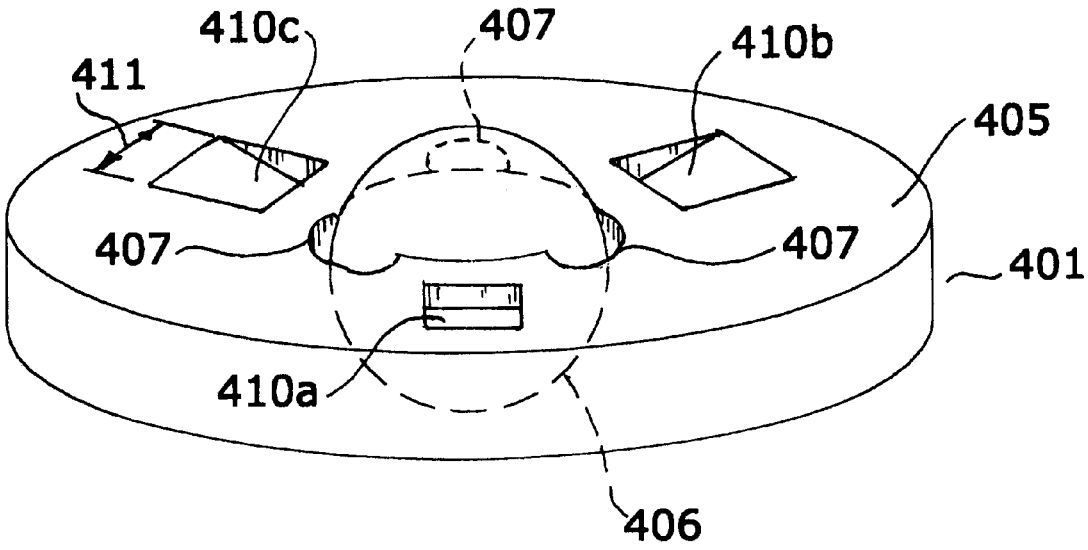
FIG. 4*c* is an isometric view of a disk-shaped armature provided with locking depressions for receiving the legs of a flexible element in accordance with the present invention.

As depicted in FIG. 4*c*, upper surface 405 of armature 401 optionally may further include locking depressions 410*a, b, c* positioned to receive flexible legs 404*a, b, c* of flexible element 402. The width of each depression, depicted as numeral 411 in FIG. 4*c*, is selected to be slightly greater than the width of corresponding flexible legs 404*a, b, c* of flexible element 402. This allows for rotation fitting of element 402 with armature 401.

Figure 5A:
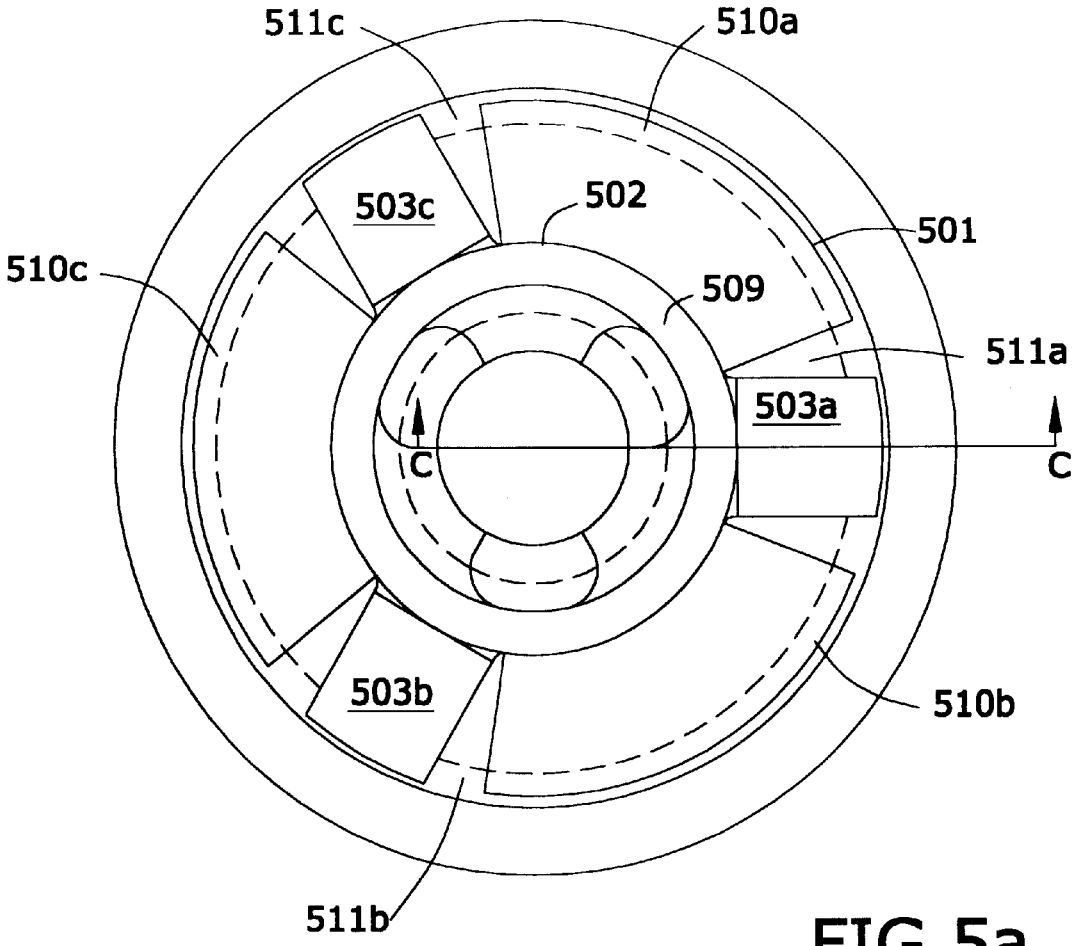
FIG. 5*a* is an upper plan view depicting a disk-shaped armature and yet a further embodiment of a flexible element in accordance with the present invention.
Figure 5B:
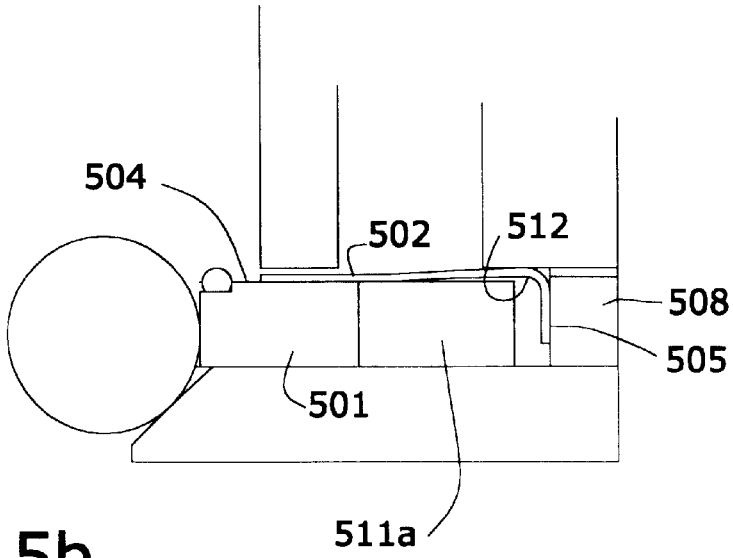
FIG. 5*b* is a cross-sectional view of the embodiment shown in FIG. 5*a*, taken along line C—C.
Figure 5C:
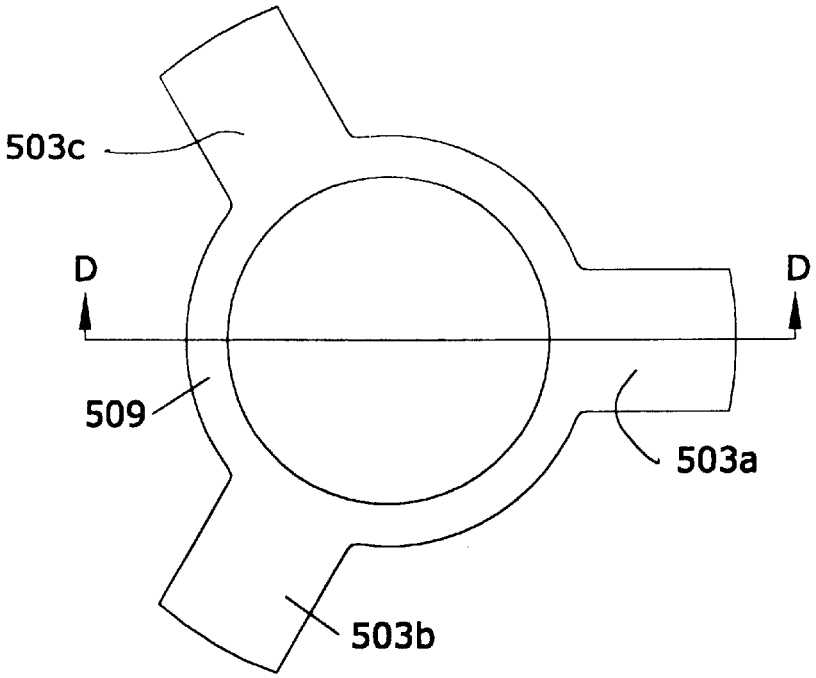
FIG. 5*c* is a top view of the flexible element shown in FIG. 5*a*.
Figure 5D:
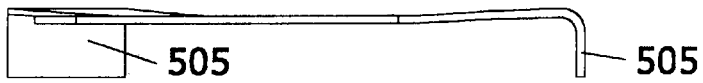
FIG. 5*d* is a cross-sectional view of the flexible element shown in FIG. 5*c*, taken along line D—D.
Figure 5E:
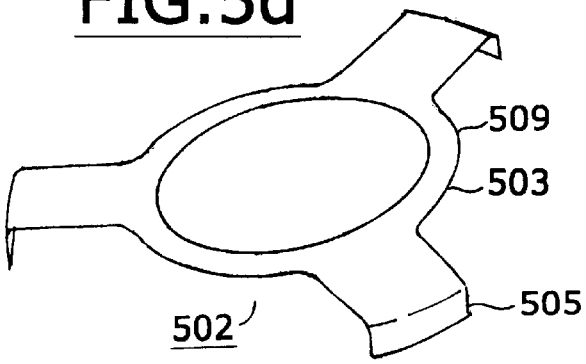
FIG. 5*e* is an isometric view of the flexible element shown in FIGS. 5*c* and 5*d*.

In FIGS. 5*a*, 5*b*, 5*c*, 5*d* and 5*e* are shown a disk-shaped armature 501 and a ring shaped flexible element 502 that includes an annular portion 509 and three spaced, outwardly projecting flexible legs 503*a*, 503*b*, and 503*c*. As depicted in FIG. 5*b*, each of the flexible legs 503*a*, 503*b* and 503*c* terminate in a downwardly extending portion 505 that is (substantially orthogonal to ring portion 509 and legs 503*a*, 503*b* and 503*c*. Flexible legs 503*a*, 503*b* and 503*c* are disposed between upper surface 504 of armature 501 and injector body surface 512 and in contact with injector body surface 512. Ring portion 509 of flexible element 502 is attached to armature upper surface 504 by, for example, spot welds (not shown). Armature 501 further optionally includes three spaced apart sectors 510*a*, 510*b* and 510*c* which are separated by clearance pockets 511*a*, 511*b* and 511*c*.

Flexible element 502 is in contact with injector body surface 512 and with upper surface 504 of armature 501 and provides a spring bias between the body and upper surface 504. Each of the outwardly projecting flexible legs 503*a*, 503*b* and 503*c* is located in one of clearance pockets 511*a*, 511*b* and 511*c*. When the fuel injector is in a closed position, spring bias between the body and upper surface 504 maintains armature 501 in a sealing position with the valve seat. As armature 501 lifts under the influence of magnetic force to its open position, flexible element 502 is deflected, thereby increasing spring bias between body surface 512 and armature upper surface 504 and urging armature 501 to return to a sealing position with the valve seat. Since there is a slight clearance between the downward portion 505 of flexible legs 503*a*, 503*b* and 503*c*, and the inner diameter of lower body portion 508, armature 501 has sufficient lateral and rotational freedom both to allow it proper seating with the valve seat and to minimize sliding friction during opening and closing of the injector.

In the embodiment shown, in FIGS. 4*a*, 4*b* flexible legs 404*a*, 404*b* and 404*c* of flexible element 402 are evenly spaced and project radially inward along diametral paths. However, it is to be understood that flexible legs 404*a*, 404*b* and 404*c* may be alternately configured and positioned, such as, for example, unevenly spaced and projecting inward at angles other than along diametral paths.

In the embodiments shown, three flexible legs are depicted. However, it is understood that the flexible elements may be alternately configured, having any number of flexible legs more or less than three.

The invention has been described in detail for the purpose of illustration, but it is understood that such detail is solely for that purpose, and variations can be made therein by those skilled in the art without departing from the spirit and scope of the invention, which is defined by the following claims.

What is claimed is:

1. An electromagnetic fuel injector comprising:

a body having a fuel inlet and a fuel outlet;

a base comprising a valve seat connected to said body;

a disk-shaped armature disposed at said fuel outlet for controlling the flow of fuel from the inlet to the outlet, said armature having an outer annular region, an upper surface and a lower surface, said lower surface comprising a sealing interface with said valve seat;

a return spring for acting on the central portion of the disk-shaped armature with a first spring bias to urge the armature against the valve seat; and a flexible element comprising a ring portion and a plurality of flexible legs, said flexible element being disposed between said body and said upper surface of said armature, said flexible element providing a second spring bias between said body and said armature upper surface and providing bias force to the outer annular region of the disk-shaped armature, said ring portion of said flexible element being attached to said armature;

wherein, when said injector is closed, spring bias between said body and said armature upper surface maintains said armature in a sealing position with said valve seat, while permitting a degree of lateral freedom for the armature to be positioned flatly on said valve seat, and when said injector is open, increased spring bias between said body and said armature upper surface impels said armature to return to a sealing position with said valve seat, while permitting a degree of lateral freedom.

2. The fuel injector of claim 1 wherein said ring portion of said flexible element is attached to said armature by welding.

3. An electromagnetic fuel injector comprising:

a body having a fuel inlet and a fuel outlet;

a base comprising a valve seat connected to said body;

a disk-shaped armature disposed at said fuel outlet for controlling the flow of fuel from the inlet to the outlet, said armature having an outer annular region, an upper surface and a lower surface, said lower surface comprising a sealing interface with said valve seat;

a return spring for acting on the central portion of the disk-shaped armature with a first spring bias to urge the armature against the valve seat; and a flexible element comprising a ring portion and a plurality of flexible legs, said ring portion of said flexible element being attached to said armature, and disposed between said body and said upper surface of said armature, said flexible element providing a second spring bias between said body and said armature upper surface and providing bias force to the outer annular region of the disk-shaped armature;

wherein, when said injector is closed, spring bias between said body and said armature upper surface maintains said armature in a sealing position with said valve seat, while permitting a degree of lateral freedom for the armature to be positioned flatly on said valve seat, and when said injector is open, increased spring bias between said body and said armature upper surface impels said armature to return to a sealing position with said valve seat, while permitting a degree of lateral freedom.

4. The fuel injector of claim 3 wherein said ring portion of said flexible element is attached to said armature by welding.

* * * * *